US005453177A

United States Patent [19]

Goebel et al.

[11] Patent Number: 5,453,177

[45] Date of Patent: Sep. 26, 1995

[54] INTEGRATED DISTILLATE RECOVERY PROCESS

[75] Inventors: Kenneth W. Goebel, Houston; Michael G. Hunter, Katy, both of Tex.

[73] Assignee: The M. W. Kellogg Company, Houston, Tex.

[21] Appl. No.: 187,932

[22] Filed: Jan. 27, 1994

[51] Int. Cl.[6] ..... C10G 49/22

[52] U.S. Cl. ..... 208/102; 208/100; 208/103; 208/104; 208/105; 208/351; 208/364; 585/264; 585/413; 585/441; 585/478; 585/655; 585/719; 585/802

[58] Field of Search ..... 208/100, 102, 208/103, 104, 105, 351, 364; 585/264, 413, 441, 478, 655, 719, 802

[56] References Cited

U.S. PATENT DOCUMENTS

| | | | |
|---|---|---|---|
| 2,853,439 | 9/1958 | Ernst, Jr. | 196/52 |
| 3,371,029 | 2/1968 | Weiland | 208/364 |
| 3,405,530 | 10/1968 | Denahan et al. | 208/351 |
| 3,408,284 | 10/1968 | Borst, Jr. | 208/105 |
| 3,607,726 | 9/1971 | Hallman | 208/103 |
| 3,671,419 | 6/1972 | Ireland et al. | 208/57 |
| 4,457,834 | 7/1984 | Caspers et al. | 208/102 |
| 4,521,295 | 6/1985 | Chervenak et al. | 208/102 |
| 4,973,396 | 11/1990 | Markley | 208/89 |
| 4,990,242 | 2/1991 | Louie et al. | 208/218 |
| 5,114,562 | 5/1992 | Haun et al. | 208/89 |

OTHER PUBLICATIONS

Hibbs et al., "Alternative Hydrocracking Applications," publsihed by UOP of Des Plaines, Ill. (1990), pp. 1–20.

Donnelly et al., *Oil & Gas Journal,* Oct. 27, 1980, pp. 77–82.

Gembicki et al., *Oil & Gas Journal,* Feb. 21, 1983, pp. 116–128.

S. L. Lee et al., "Aromatics Reduction and Cetane Improvement of Diesel Fuels," published by Akzo Chemicals NV. pp. 1–13 (No Date).

O Biceroglu et al., "The Kinetic of Aromatic Saturation Reactions During Hydrotreating of Middle Distillates", IOL, pp. 1–5 (No Date).

Manufactuer's sales brochure for MAK hydrocracking technology, chemical sales and processes, Mobil Corporation, Akzo Chemicals and The M. W. Kellogg Company (No Date).

*Primary Examiner*—Sharon A. Gibson
*Assistant Examiner*—Walter D. Griffin
*Attorney, Agent, or Firm*—The M. W. Kellogg Company

[57] ABSTRACT

An integrated three-column process for recovering hydrocarbon distillate products from a hydroprocessing or hydrocracking reactor effluent stream and a hydrocarbon distillate product recovery train are disclosed. According to the present recovery process, an effluent stream from the cracking reactor is cooled and separated into light and heavy phase streams. The heavy phase stream is depressurized and stripped of light end components in a steam stripping column. The light phase stream is further cooled to separate a liquid stream which is combined with the light ends from the stripper and fed to a debutanizer. A $C_4$-rich light end stream taken overhead from the debutanizer is condensed to produce LPG product stream(s). A $C_4$-lean heavy end stream removed from the bottoms of the debutanizer is combined with a heavy end bottoms stream from the stripper and fed to a fractionator for fractionation into product distillate streams such as light and heavy naphtha, jet fuel, diesel oil, and the like. A heavy oil bottoms stream recovered from the fractionator is recycled back to the cracking reactor.

9 Claims, 2 Drawing Sheets

INTEGRATED DISTILLATE RECOVERY PROCESS

FIELD OF THE INVENTION

The present invention relates to an integrated process for recovering liquid petroleum products from a petroleum hydro-conversion reactor effluent stream.

BACKGROUND OF THE INVENTION

The conversion of petroleum and other similar higher molecular weight hydrocarbon feedstocks into useful lower molecular weight products such as liquid petroleum gas, gasoline, jet fuel and diesel oil is well known in the art. Commonly employed conversion reactions, for improving the quality of various hydrocarbon feedstocks and/or cracking higher molecular weight-higher boiling materials to lower molecular weight-lower boiling products, include hydroprocessing (mild and severe) and hydrocracking. Mild hydroprocessing is typically conducted at a temperature of from 350° C. to 425° C. and at a pressure of from 3.5 to 10 MPa using a fixed-bed catalyst without regeneration. Severe hydroprocessing is typically carried out at higher pressures—from 7 to 21 MPa—and the fixed bed catalyst has a regeneration cycle. The conditions in hydrocracking are similar to those of hydroprocessing except that the severity of the reaction conditions is increased and the catalyst contact times are longer.

The effluent stream from a conversion reactor will comprise a wide range of molecular weight hydrocarbons which can be processed downstream for recovery of hydrocarbon products useful for various purposes. The product recovery train typically combines a means for separating out light end components (e.g. butanes and lighter) and a fractionator tower for recovering the distillate products (e.g. pentanes and heavier). Prior to product recovery, however, reaction heat is generally recovered for preheating the reactor feed stream wherein the effluent stream is cooled and a heavy phase is condensed. The mixed-phase stream thus formed is directed to a separation drum to effect phase separation. Since the feed preheat (and effluent cooling) is typically conducted in two stages, "hot" and "cold" liquid steams of substantially constant pressure and overlapping composition are produced. These liquid streams are then generally recombined, depressurized and directed to the product recovery train for further separation.

Separation techniques typically utilized for recovery of the remaining light end fraction include either a steam stripping or a debutanizer distillation column. The heavy end components can be fractionated into the hydrocarbon distillate products using a low pressure fractionation column. As is well known in the art, either the fractionation column or light end separation column can be placed first in the product recovery train.

Several drawbacks have been noted for both schemes as operated in the prior art (either light end separator or fractionator first). Where the light end separator comprises a stripper column placed upstream of the fractionator, the vessel must be sized to accept the entire reaction effluent stream. Due to the presence of hydrogen sulfide in the effluent stream, the vessel must be constructed from a corrosion-resistant material. Downstream production quantities of light naphtha (for gasoline) are less than that of a fractionation-first process since a portion of the light naphtha product is lost in the stripper overhead stream. Further, the stripper overhead stream cannot be condensed to produce liquid petroleum gas. Thus, a stripper-first recovery process cannot duplicate the product recovery distribution of the fractionator-first scheme.

Alternatively, the light end separator can comprise a debutanizer placed upstream from the fractionator. This recovery scheme also has some serious drawbacks. Again, the column must be sized to accept the entire effluent stream. Due to the presence of the entire hydrocarbon cut, the debutanizer reboiler must be operated at a high temperature—on the order of 340° C. to 370° C. Therefore, the reboiler must be fired since process heat is unavailable at this relatively high temperature.

In an alternative embodiment, the fractionator column can be placed upstream of a debutanizer to avoid having to reboil the heaviest components. Receiving only the overheads from the fractionator, the debutanizer can be sized smaller. However, the fractionator operates at a lower pressure than the debutanizer, so the debutanizer feed must be cooled and recompressed with a corresponding loss of work and increased capital expenditure. Clearly, it would be highly advantageous, particularly from an energy efficiency and capital expenditure standpoint, to avoid recombining separated streams, reheating cooled streams and recompressing lower pressure steams while maintaining product range flexibility.

SUMMARY OF THE INVENTION

In an integrated three-column process of the present invention, the relatively warm and cool high pressure liquid streams produced by two-stage cooling of the reaction effluent stream are processed separately for light ends separation prior to distillate fractionation. The light ends separated from the warm liquid stream in a stripping column are combined with the cool liquid stream and fed to the debutanizer column. Compared to the two-column prior art, the present process substitutes smaller vessels for larger ones and reduces or eliminates the need for fired reboiler heating as compared to a debutanizer-first process, substitutes smaller vessels for larger ones and enhances liquid petroleum gas (LPG) recovery as compared to a stripper-first process, and obviates the need for downstream recompression as compared to a fractionator-first process.

In one embodiment, the present invention provides a process for recovering products from a hydro-conversion reactor effluent stream. As step (a), the effluent stream is separated at a relatively high pressure and temperature into a hot vapor stream and a hot liquid stream. As step (b), the hot liquid stream from the separation step (a) is fed to a stripping zone operated at a moderate pressure relatively lower than the separation step (a) to form a hot overhead vapor stream, and a hot bottoms stream essentially free of butane and lighter components. In step (c), the vapor stream from the separation step (a) is cooled and separated into relatively cool vapor and liquid streams. The overhead vapor stream from the stripping zone, and the liquid stream from the separating step (c), are debutanized in step (d) in a column operated at a relatively moderate pressure to obtain one or more light component product streams essentially free of pentane and heavier components and a debutanized liquid stream. The hot bottoms stream from the stripping zone of step (b) and the debutanized liquid stream from debutanizing step (d) are fractionated in step (e) in a column operated at relatively low pressure into a plurality of petroleum distillate products and a residual bottoms stream. The present process can further comprise the steps of: (1) mixing the vapor stream from the feed step (b) with the liquid stream from step (c); and (2) separating the mixture from step (1) at moderate pressure into a volatile vapor stream and a liquid stream for feed to the debutanizing step (d). The pressure of the effluent stream in the separation step (a) preferably exceeds about 3 MPa, the moderate pressures in the stripping zone and the debutanizing step (d) are preferably greater than 1 MPa and less than 3 MPa, and the low pressure in the fractionation step (b) is preferably less than about 0.5 MPa.

In a preferred embodiment, the stripping zone in the feed step (b) is preferably heated by steam supplied adjacent a lower end of the stripping zone. The hot overhead vapor stream from the stripping zone in step (b) is preferably cooled in heat exchange against the liquid stream from step (2). The debutanizing column in step (d) is preferably reboiled by heat exchange against the high temperature reactor effluent stream. The hot bottoms stream from step (b) is preferably at least partially heated for the fractionation step (e) by heat exchange against the high temperature reactor effluent stream. The steam supplied to the stripping zone in step (b) is preferably generated by heating water in heat exchange against the residual bottoms stream from the fractionation step (e). The volatile vapor stream from step (2) preferably contains hydrogen and methane, and the light-component product streams from the debutanizing step (d) include a vapor stream containing methane and a liquefied petroleum gas stream. The petroleum distillate products preferably comprise light naphtha, heavy naphtha, jet fuel, diesel fuel or a combination thereof.

As another aspect, the present invention provides a unit for recovering products from a hydro-conversion reactor effluent stream. A hot, high pressure separator is provided for separating the effluent stream into vapor and liquid streams. A stripping zone is provided for stripping volatile components from the liquid stream from the hot high pressure separator at a moderate pressure, and producing a bottoms stream stripped essentially free of butane and lighter components, and an overhead vapor stream. A cold, high pressure separator is provided for separating the vapor stream from the hot, high pressure separator at a relatively lower temperature into a vapor stream suitable for recycle to the reactor and a liquid stream. A debutanizer column is provided for debutanizing at least a portion of the overhead vapor stream from the stripping zone and the liquid stream from the cold, high pressure separator, at a moderate pressure to obtain one or more light component product streams essentially free of pentane and heavier components, and a debutanized liquid stream. A fractionation column is provided for distilling the debutanized liquid stream and the bottoms stream from the stripping zone, at a relatively low pressure into a plurality of petroleum distillate products and a residual bottoms stream. The unit can include a cold, low pressure separator for separating a mixture of the liquid stream from the cold, high pressure separator and the overhead stream from the stripping zone at a moderate pressure into a volatile vapor stream, and a liquid stream for feed to the debutanizer column. High pressures in the unit exceed about 3 MPa, moderate pressures are greater than 1 MPa and less than 3 MPa, and the unit low pressure is preferably less than about 0.5 MPa.

In a preferred embodiment, the unit preferably comprises a line for supplying steam into a lower end of the stripping zone. A heat exchanger is preferably provided for cooling the overhead stream from the stripping zone against the liquid stream from the cold, low pressure separator. A reboiler is preferably provided for heating a stripping zone of the debutanizer column against the high temperature reactor effluent streams. Heat exchangers are preferably provided for heating the bottoms stream from the stripping zone against the relatively higher temperature reactor effluent stream. A heat exchanger is preferably provided for generating steam for the stripping zone by an exchange of heat against the residual bottoms stream. The unit is preferably adapted for producing a vapor stream comprising hydrogen and methane from the cold, high pressure separator, for producing light naphtha, heavy naphtha, jet fuel, diesel fuel, or a combination thereof as the petroleum distillate products, and the light-component product streams from the debutanizer preferably include a vapor stream containing methane and a liquefied petroleum gas stream.

DETAILED DESCRIPTION OF THE INVENTION

Feeding a first portion of an effluent stream from a hydro-conversion reactor to a steam stripping column and a second portion of the reactor effluent stream to a debutanizer distillation column for light ends separation prior to heavy ends fractionation can enhance energy and product recovery efficiency, and lower capital costs. In such a manner, work lost from recombination of already separated streams can be avoided, the size of the light end recovery column can be made smaller, the debutanizer can be reboiled using process and utility heat instead of a fired reboiler, and downstream compression and cooling commonly required for feed to the debutanizer can be eliminated entirely.

Figure 1:
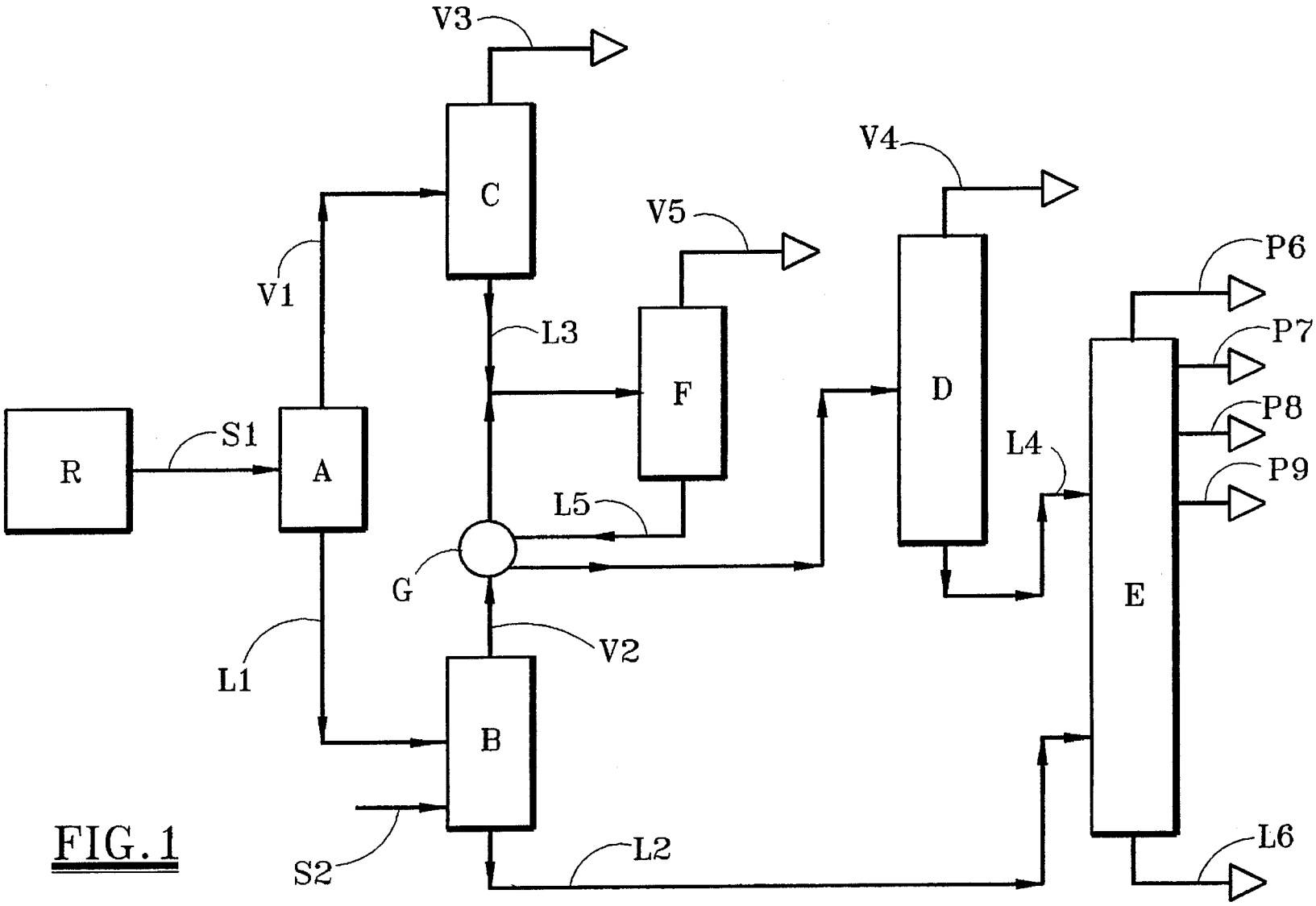
FIG. 1 shows a simplified block flow diagram of a front end conversion reactor feeding to an integrated distillate recovery process according to the present invention.

Referring to FIG. 1 for a brief overview of the present process and unit, a hydrocarbon feedstock is converted in hydro-conversion reactor R, and the effluent stream S1 therefrom is separated in hot, high pressure separator A into respective vapor and liquid streams V1, L1. The hot liquid stream L1 is fed to stripper B which is operated at a moderate pressure lower than the separator A. Steam can be supplied via line S2 to a lower end of the stripper B. A hot overhead vapor stream V2 and a hot bottoms stream L2 are obtained from the stripper B. The stream V1 is cooled and fed to separator C to obtain cool vapor stream V3 and cool liquid stream L3.

All or a portion of the vapor stream V2 and liquid stream L3 are debutanized in debutanizer D to obtain a debutanized liquid stream L4 for feed to the fractionator E and an overhead stream V4 essentially free of pentane and heavier components. Desirably, the streams V2 and L3 are first mixed together and then separated in separator F into a volatile stream V5 and a liquid stream L5 for feed to the debutanizer D. A cross exchanger G is desirably provided to heat stream L5 prior to fractionation against stream V2 which is cooled to facilitate vapor-liquid separation in the separator F.

The streams L2 and L4 are then distilled in the fractionator E which is operated at a relatively low pressure to obtain a plurality of overhead and side-draw product streams P6, P7, P8, and P9 and a residual bottoms stream L6. In contrast to prior art schemes where the entire liquid fraction from the high pressure separators was fed to either a light end separator or a fractionator, the liquid streams from the hot and cold separations in the present processing scheme are split between feeds directly to the fractionator E and indirectly via the debutanizer D. The split between the total liquid feed in streams L5 and L2 will depend on the severity of operation in the hydrocracking reactor R, greater severity generally increasing the production of light components fed in stream L5. The present process is applicable where either or both naphtha and diesel are the primary desired product, but the benefits obtained are more pronounced when diesel products are desired (as opposed to naphtha products) since the portion of liquid feed in the stream L2 is greater. The percentage of the total mass flow rate in the stream L2 directly to the fractionator E, and L5 to the debutanizer D (and then via bottoms stream L4 to the fractionator E), is generally from about 10 to about 70 percent in stream L5 and from about 90 to about 30 percent in stream L2 (i.e. a weight ratio of stream L5:L2 of about 10:90 to about 70:30), preferably from about 10 to about 40 percent in stream L5 and from about 90 to about 60 percent in stream L2 (i.e. a weight ratio of stream L5:L2 of about 10:90 to about 40:60).

Figure 2:
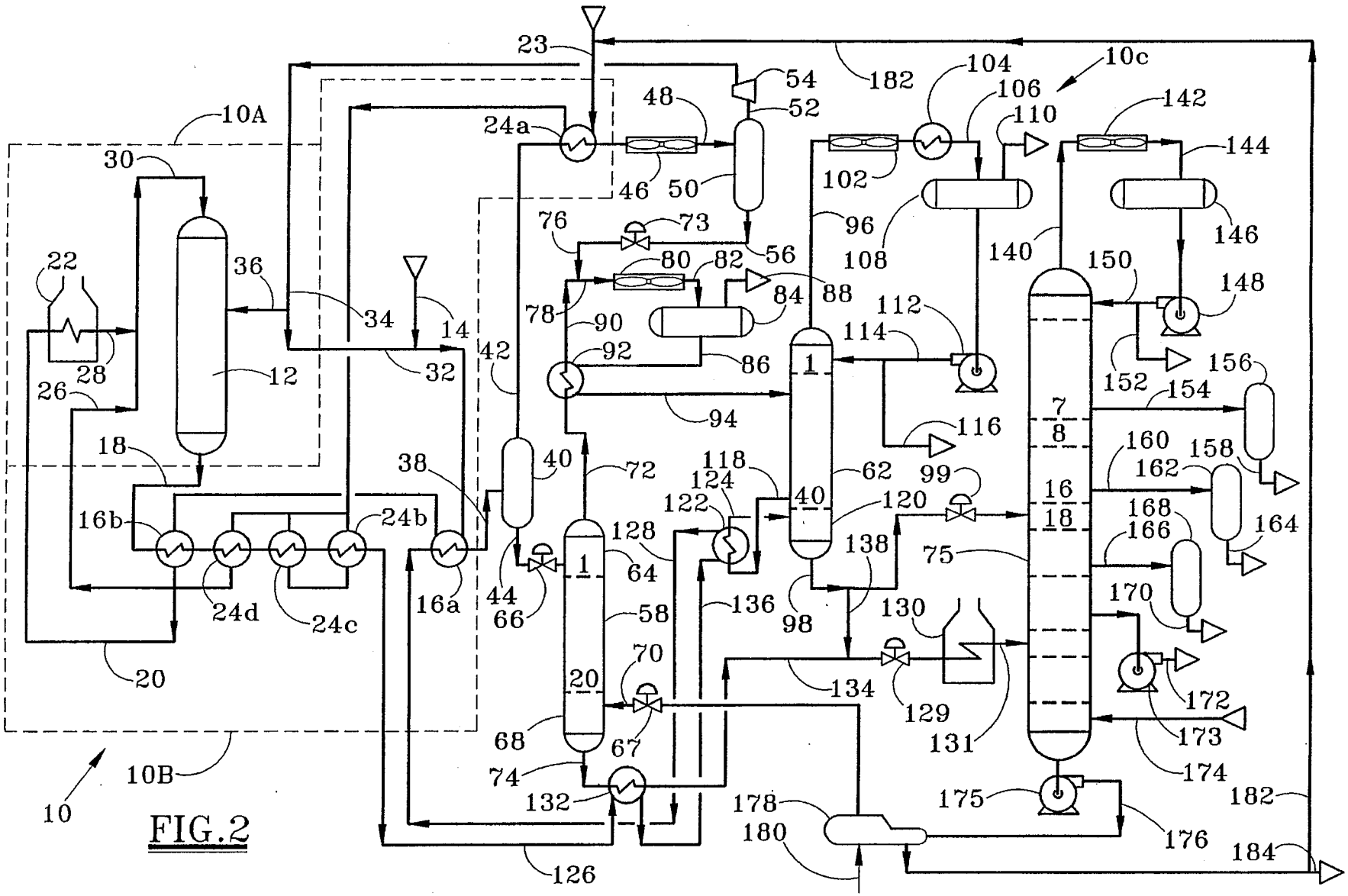
FIG. 2 shows a more detailed schematic flow diagram of one embodiment of the integrated distillate recovery process of FIG. 1.

Referring to the representative specific embodiment illustrated in FIG. 2, a petroleum refining process 10 of the present invention includes a front end reaction hydro-conversion zone 10A, heat recovery zone 10B, and an integrated distillate product recovery zone 10C. Operation of the reaction hydro-conversion zone 10A is well known in the art. Briefly, a hydro-conversion reactor 12 converts a higher molecular weight liquid hydrocarbon feed such as crude petroleum (suitably desalted and dewatered as necessary as is known in the art) in the presence of heat, elevated pressure, a suitable catalyst and hydrogen, into a range of lower molecular weight hydrocarbon products which are eventually separated into distillate hydrocarbon fractions in the downstream product recovery zone 10C. Prior to product recovery, however, the reaction effluent is passed through heat recovery zone 10B wherein heat of reaction can be used to perform a variety of process heating steps, including preheating the reaction feed stream and generating steam.

Depending on the type of conversion reaction desired, such as, for example, hydroprocessing—mild or severe, or hydrocracking, the reactor 12 will operate at a temperature of from 350° C. to 400° C. and at a pressure of 1.5 MPa to 2.2 MPa (mild hydroprocessing), or at a temperature of from 350° C. to 500° C. and a pressure of from 7 to 21 MPa (severe hydroprocessing and hydrocracking). A fixed bed catalyst will typically be used for hydroprocessing and hydrocracking reactions (with or without catalyst regeneration).

According to common practice, a makeup hydrogen feed stream is introduced through line 14 into recycle hydrogen-containing gas line 32 and passed in heat exchange through a series of heat exchangers 16*a*, 16*b* to preheat the hydrogen-containing stream and recover heat from a reaction effluent stream 18. A preheated hydrogen-containing stream 20 is then further heated to reactor temperature in a fired furnace 22. A feed stream 23 including feedstock and recycle oil from line 182 is passed in heat exchange through a series of heat exchangers 24*a*, 24*b*, 24*c*, 24*d* to preheat the feed stream and recover additional heat from the reaction effluent stream 18. The preheated feed stream 26 is combined with the heated gas stream 28 from the furnace 22 and fed through line 30 to the reactor 12. In addition, a sidestream 36 of the recycle gas stream 34 can be used as quench gas between reactor catalyst beds. As is known in the art, the amount of hydrogen consumed by hydroprocessing and cracking reactions typically increases with the severity of the reaction conditions employed and depends on the amount of sulfur, aromatic materials and olefins in the feed.

Reaction effluent stream 18 is suitably cooled in the heat recovery zone 10B and directed through line 38 to the distillate product recovery train 10C. In the product recovery train 10C, the stream 38 containing a wide spectrum of lower molecular weight materials is separated into a desired range of distillate fractions useful for a broad range of purposes. Liquid hydrocarbon products recovered from the reactor effluent stream include liquid petroleum gas (LPG), light naphtha fraction (LNAP), heavy naphtha fraction (HNAP), jet fuel and diesel fuel. In addition, an offgas is usually produced and a bottoms stream heavier than diesel oil is often recycled to the reactor 12 as the recycle oil stream 182.

As is well known, upon cooling, the reaction effluent stream 38 becomes distinguishable into phases of higher and lower temperature boiling fractions for which a rough separation can be made. Consequently, the cooled effluent stream 38 is piped first to a high pressure separator 40 wherein a vapor phase stream is removed through line 42 and a liquid phase stream is removed through line 44. The vapor phase stream 42 is then further cooled by heat exchange with the recycle oil stream in exchanger 24*a*, as mentioned above, and then in an air cooler 46, to effect further condensation from vapor stream 42. A cooled, partially condensed stream is fed in line 48 to a second high pressure separator 50 operating at a lower temperature than the first high pressure separator 40. From the second high pressure separator 50, a vapor stream comprising primarily gaseous hydrogen and methane is removed through line 52. The vapor stream 52 is then compressed by compressor 54 to form the hydrogen-rich recycle gas stream 34. A liquid phase stream is removed from the second high pressure separator 50 through line 56.

In the practice of the present invention, the liquid stream 44 from the first high pressure separator 40 and the liquid stream 56 from the second high pressure separator 50 are not combined in toto, as was characteristic of the prior art. Instead, the warm liquid stream 44 is first separately stripped of light end components in a steam stripping column 58, for example, and only the recovered light ends are subsequently combined with the cool liquid phase stream 56. At least a portion of the resulting combined stream 78 is then fed to a debutanizer column 62. Thus, by employing a light-ends-recovery-first arrangement, the desired operating pressures of the stripping column 58 and the debutanizer column 62 can be specified and achieved, without the need for a downstream recompression stage, as was commonly heretofore employed in the prior art; and by splitting the feed to the light end recovery equipment between steam stripper 58 and debutanizer 62, smaller size vessels can be used. In addition, use of a stripper/debutanizer combination in the present process for light end recovery enhances LPG production efficiency over prior art arrangements.

The liquid stream 44 from the first high pressure separator 40 is introduced to an upper end 64 of the stripper 58 through a pressure let-down valve 66, and stripping steam is throttled through let-down valve 67 for introduction adjacent a lower end 68 through line 70. A light-end-rich stream exits from the upper end 64 through line 72, and a bottoms stream is removed from the stripper 58 via line 74 for feed to a fractionator column 75. As is well known in the separation arts, the stripper 58 will typically include a suitable number of contacting trays (usually about 10–30) and/or packing elements for enhancing hydrocarbon/steam contact surface area. Operating pressure of the stripper 58 will be moderate, ranging from about 1.4 to about 2.4 MPa (200–350 psig).

The liquid phase stream 56 removed from the second high pressure separator 50 is depressurized through pressure let-down valve 73 for introduction to the debutanizer 62 via lines 76 and 78. The light-end-rich stream 72 from the stripper 58 is also introduced thereto to form a combined stream in the line 78. The combined stream in line 78 is cooled to a temperature on the order of 40°–60° C., preferably by an air cooler 80, to condense a heavy phase. A mixed phase stream is directed through line 82 to a low pressure separator vessel 84 operating at about the pressure of the debutanizer 62, e.g. on the order of about 1.4–2.4 MPa (200–350 psig). From the low pressure separator 84, a liquid phase stream is separated and fed to the debutanizer 62 through line 86. A vapor phase stream comprising primarily hydrogen, methane and hydrogen sulfide is removed through line 88.

The light-end-rich stream 72, prior to combination with the depressurized liquid phase stream 76 from the second high pressure separator 56, can be cooled in a heat exchanger 92 to a temperature on the order of 100°–200° C. to produce a light end-rich stream 90. The light-end-rich stream 72 is preferably cooled by an exchange of heat against the liquid phase stream 86 from the low pressure separator 84 in the heat exchanger 92. In such a manner, the light-end-rich stream 72 can be cooled and the liquid phase stream 86 can be preheated to a temperature on the order of 120°–180° C. for feed through line 94 to a feed zone of the debutanizer 62.

Due to its smaller size, and the prior separation of a significant portion of the heaviest hydrocarbon components from the debutanizer feed stream 94, the debutanizer 62 can be operated at a much lower bottoms equilibrium temperature (generally well below 300° C., preferably from about 200° to about 250° C) and much smaller flows for a greatly reduced heat duty, in contrast to the prior art. Therefore, the present debutanizer 62 can be reboiled using process heat produced by the conversion reactor 12. Thus, the present process and unit eliminates the need for a large fired reboiler commonly required in prior art debutanizers.

The preheated debutanizer feed stream 94 is introduced to the debutanizer 62 at a feed zone thereof. In the debutanizer 62, substantially all of the C4 and lighter hydrocarbon components, including non-hydrocarbon impurities such as hydrogen sulfide, water, ammonia and remaining hydrogen, are recovered overhead via line 96. A debutanizer bottoms stream 98 is removed from the debutanizer 62 for feed to the fractionator column 75.

The debutanizer overhead stream via line 96 is partially condensed using an air cooler 102 and a water-cooled heat exchanger 104 to provide a condensate reflux stream 106 for the debutanizer 62. The partially condensed stream 106 is directed to a separator drum 108 at a pressure usually about 0.03 MPa (5 psi) less than the debutanizer 62 pressure to effect vapor-liquid separation. An offgas vapor stream 110 comprising primarily hydrogen sulfide, hydrogen and C1–C2 light hydrocarbons is removed from the separator drum 108. The liquid phase stream 114 comprising primarily C3–C4 light hydrocarbons is pumped by pump 112 as reflux for the debutanizer 62. A sidestream 116 of the reflux stream 114 is withdrawn as an LPG product.

A liquid stream 118 from the debutanizer 62 is withdrawn from a lower end 120 for feed to a reboiler 122. Reboiled fluid is returned to the lower end 120 of the debutanizer 62 through line 124. The heating medium for the reboiler 122 is preferably the hot reaction effluent in line 136 from the heat recovery train 10B. Following heat exchange, a relatively cooler reaction effluent stream is returned to the heat recovery train 10B through line 128.

The debutanizer bottoms stream 98 is throttled by let-down valve 99 to about atmospheric pressure for introduction to the fractionator tower 75. The fractionator feed stream is introduced at a relatively high feed tray conforming in temperature to that of the feed—approximately 200°–250° C. The stripper bottoms stream 74 is preferably depressurized by let-down valve 129 and introduced to the fractionator tower 75. Consequently, the stripper bottoms stream 74 is preferably vaporized at a temperature on the order of 300°–400° C. in a furnace 130 and fed to the fractionator tower 75 through line 131. Prior to heating in the furnace 130, the stripper bottoms stream 74 is preferably preheated by an exchange of heat with the reaction effluent from line 126 in preheater 132. The preheated stripper bottoms stream 134 is directed to the furnace 130, and the reactor effluent sidestream 136 exiting the preheater 132 can then be directed as a heating medium to the debutanizer reboiler 122, as described above. In the event that more fractionator reboiled fluid is required than is available from the stripper bottoms line 134, a sidestream 138 can be diverted from the debutanizer bottoms stream 98 for additional feed to the furnace 130.

In the fractionator tower 75, appropriate hydrocarbon distillate fractions are produced, either as a fuel product having the desired specifications or as feed to a product finishing column. Overall, operation and design of the fractionator tower 75 and associated finishing columns are well known in the art. The distillate fractions conform to suitable bubble point ranges for the product (or finishing column) in question and are removed from the tower 75 as a sidedraw from the reflux liquid and several of the intermediate trays. Bottoms liquid comprises a recycle oil which can be returned to the conversion reactor 12 through line 182 as mentioned previously. Such a tower 75 will generally contain about 30–50 vapor-liquid equilibrium trays or stages and operate at an overhead temperature and pressure on the order of 100°–140° C. and 0.07–0.21 MPa (10–30 psig) and a bottoms temperature and pressure of approximately 300°–400° C. and 0.14–0.27 MPa (20–40 psig).

The tower overhead vapor line 140 is preferably cooled in an air cooler 142 to condense the vapor as a reflux condensate. Reflux condensate in line 144 is directed to an accumulator drum 146 for feeding a reflux pump 148. The reflux pump 148 returns the reflux condensate to the tower 75 through line 150 except for an overhead distillate which can be removed through line 152 as a light naphtha product stream. Further down the tower 75 in the vicinity of the seventh-eighth trays (from the top), a distillate sidedraw 154 can be removed from tower 75 to feed a heavy naphtha stripping column 156. A heavy naphtha product can be taken off as a bottoms product from the stripping column 156 through line 158. In the vicinity of the sixteenth-eighteenth trays (from the top), another distillate side draw 160 can be removed from tower 75 to feed a jet fuel stripping column 162. Jet fuel is produced as a bottoms product from the stripping column 162 through line 164. Further down the tower 75 in the vicinity of the twenty-fourth tray (from the top), a further distillate sidedraw can be removed through line 166 to feed a diesel oil stripping column 168. Diesel oil is produced as a bottoms product from the stripping column 168 through line 170. Further down the tower 75 adjacent the lower end, a kerosene and/or heating oil product sidedraw 172 can be removed via pump 173.

Low pressure steam is preferably introduced to the bottom of the tower 75 through line 174. Recycle oil pumped by pump 175 from the tower bottoms through line 176 is preferably used as a heating medium in a boiler 178 to produce steam for the steam stripper 58. The boiler 178 is connected to a boiler feed water supply line 180. The recycle oil leaving the boiler 178 is pumped through line 182 back to the reaction conversion train 10A via the heat recovery train 10B as described above, except for a purge stream 184.

The present invention is further illustrated by reference to the following example.

EXAMPLE

The integrated distillate product recovery process of the present invention employing a three-column arrangement as shown in FIG. 2 is simulated by computer to estimate the flowrate and composition of selected, primary process streams. The simulation results are presented in the Table.

TABLE

| | Line No. | | | | | | | | |
|---|---|---|---|---|---|---|---|---|---|
| | 44 | 56 | 72 | 88 | 94 | 110 | 116 | 98 | 74 |
| | Phase | | | | | | | | |
| | Liquid | Liquid | Vapor | Vapor | Mixed | Vapor | Liquid | Liquid | Liquid |
| | Temp. (°C.) | | | | | | | | |
| | 232 | 49 | 237 | 49 | 149 | 38 | 38 | 230 | 233 |
| | Press. (MPa(g)) | | | | | | | | |
| Comp. | 14.0 | 13.8 | 2.17 | 2.07 | 2.03 | 1.34 | 1.34 | 1.45 | 2.20 |
| | Molar Flowrates (kg-mole/hr) | | | | | | | | |
| $H_2O$ | 1.0408 | 1.7367 | 431.535 | 2.0365 | 2.0757 | 0.4938 | 0.0508 | 0 | 101.645 |
| $NH_3$ | 0.9366 | 0.0053 | 0.9365 | 0.2932 | 0.6486 | 0.5428 | 0.1058 | 0 | 0.0001 |
| $H_2S$ | 34.2006 | 65.4886 | 34.1984 | 41.2814 | 58.1591 | 45.6350 | 12.5238 | 0 | 0.0022 |
| $H_2$ | 221.107 | 69.5382 | 221.107 | 279.325 | 11.3200 | 11.1780 | 0.1421 | 0 | 0 |
| $C_1$ | 19.4227 | 16.3161 | 19.4227 | 28.7970 | 6.9418 | 6.5825 | 0.3593 | 0 | 0 |
| $C_2$ | 4.4232 | 7.7494 | 4.4231 | 5.81875 | 6.3549 | 5.1841 | 1.1708 | 0 | 0.0001 |
| $C_3$ | 6.8460 | 18.0472 | 6.8424 | 5.7959 | 19.0937 | 11.5719 | 7.5215 | 0.0003 | 0.0037 |
| $iC_4$ | 13.2834 | 40.2311 | 13.2321 | 6.5371 | 46.9259 | 27.3230 | 0.1357 | 0.0513 | |
| $nC_4$ | 7.5085 | 20.8199 | 7.4557 | 2.5868 | 25.6891 | 8.6921 | 16.4062 | 0.5905 | 0.0527 |
| $C_5$-93° C. | 91.1915 | 233.111 | 75.3462 | 7.2780 | 301.179 | 0.3790 | 1.1620 | 299.637 | 15,8454 |
| 93-149° C. | 146.451 | 182.514 | 64.5507 | 0.5525 | 246.511 | 0 | 0 | 246.511 | 81.8998 |
| 149-266° C. | 338.889 | 149.116 | 55.0387 | 0.0546 | 204.100 | 0 | 0 | 204.100 | 283.851 |
| 266-360° C. | 112.984 | 6.0225 | 2.1643 | 0 | 8.1869 | 0 | 0 | 8.1869 | 110.820 |
| 360° C.+ | 138.160 | 0.3894 | 0.1264 | 0 | 0.5157 | 0 | 0 | 0.5157 | 138.033 |
| Total 1 | 1136.44 | 811.085 | 936.379 | 380.602 | 937.702 | 109.726 | 66.7653 | 759.679 | 732.204 |
| Total 2 (kg/hr) | 182,840 | 70,952 | 33,709 | 4043.4 | 92,885 | 4028.6 | 3418.4 | 85,411 | 158,718 |
| | Flowrate (bbl/day) | | | | | | | | |
| C2- | 1402.25 | 962.829 | 2572.17 | 1796.10 | 572.592 | 467.987 | 100.444 | 0 | 276.252 |
| C3–C4 | 409.017 | 1174.78 | 407.380 | 216.443 | 1365.71 | 584.910 | 769.825 | 10.9711 | 1.6368 |
| C5-93° C. | 1664.75 | 4196.92 | 1360.63 | 122.977 | 5434.57 | 5.7931 | 17.7614 | 5411.01 | 304.120 |
| 93–149° C. | 3390.73 | 4182.30 | 1480.46 | 12,2051 | 5650.45 | 0 | 0 | 5650.45 | 1910.27 |
| 149–266° C. | 10821.7 | 4425.56 | 1634.54 | 1.4935 | 6058.61 | 0 | 0 | 6058.61 | 9187.15 |
| 266–360° C. | 5766.58 | 288.427 | 103.448 | 0.0004 | 391.875 | 9 | 9 | 391.874 | 5663.13 |
| 360° C.+ | 12302.7 | 27.6323 | 8.9297 | 0 | 36.5620 | 0 | 0 | 36.5620 | 12293.7 |
| Total | 35757.7 | 15258.4 | 7567.56 | 2149.32 | 19510.4 | 1058.69 | 888.030 | 17559.5 | 29636.3 |

The present petroleum distillate recovery process is illustrated by way of the foregoing description and examples.

The foregoing description is intended as a non-limiting illustration, since many variations will become apparent to those skilled in the art in view thereof. It is intended that all such variations within the scope and spirit of the appended claims be embraced thereby.

We claim:

1. A process for recovering products from a hydroconversion reactor effluent stream, comprising the steps of:

(a) separating the effluent stream at a pressure exceeding about 3 MPa into a hot vapor stream and a hot liquid stream;

(b) feeding the hot liquid stream from step (a) to a stripping zone operated at a pressure greater than about 1 MPa and less than about 3 MPa to form a hot overhead vapor stream, and a hot bottoms stream essentially free of butane and lighter components;

(c) cooling and separating the hot vapor stream from step (a) at a pressure of about the pressure in step (a) into cool vapor and liquid streams and reducing the cool liquid stream to a pressure of about the pressure in the stripping zone of step (b);

(d) debutanizing at least a portion of the hot overhead vapor stream from step (b) and the cool liquid from step (c) in a debutanizing column operated at a pressure of about the pressure in the stripping zone of step (b) to obtain one or more light-component product streams essentially free of pentane and heavier components and a debutanized liquid stream; and (e) fractionating the hot bottoms stream from step (b) and the debutanized liquid stream from step (d) in a fractionation column operated at a pressure of less than about 0.5 MPa into a plurality of petroleum distillate products and a residual bottoms stream.

2. The process of claim 1, further comprising the steps of (1) mixing the vapor stream from step (b) with the liquid stream from step (c) and (2) separating the mixture from step (1) at a pressure greater than about 1 MPa and less than about 3 MPa Into a volatile vapor stream and a liquid stream for feed to the debutanizing step (d).

3. The process of claim 2, wherein the stripping zone in step (b) is stripped by steam supplied adjacent a lower end of the stripping zone.

4. The process of claim 2, wherein the hot overhead vapor stream from step (b) is cooled in heat exchange against the liquid stream from step (2).

5. The process of claim 2, wherein the debutanizing column in step (d) is at least partially reboiled by heat exchange against the reactor effluent stream or the residual bottoms stream from step (e).

6. The process of claim 2, wherein the bottoms stream from step (b) is partially heated for the fractionation step (e) by heat exchange against the reactor effluent stream.

7. The process of claim 3, wherein the steam supplied to the stripping zone in step (b) is generated by heating water in heat exchange against the reactor effluent stream or the residual bottoms stream from the fractionation step (e).

8. The process of claim 2, wherein the volatile vapor stream from step (2) contains hydrogen and methane, and the light-component product streams from step (d) include a vapor stream containing methane and a liquefied petroleum gas stream.

9. The process of claim 2, wherein the petroleum distillate products comprise light naphtha, heavy naphtha, jet fuel, diesel fuel or a combination thereof.

* * * * *